US005741171A

United States Patent [19]

Sarfaty et al.

[11] Patent Number: 5,741,171

[45] Date of Patent: Apr. 21, 1998

[54] PRECISION POLISHING SYSTEM

[75] Inventors: Ori Sarfaty, Ramat Hasharon; Yossi Hay, Herzlia; Dan Gunders, Reut, all of Israel

[73] Assignee: Sagitta Engineering Solutions, Ltd., Ramat Gan, Israel

[21] Appl. No.: 699,309

[22] Filed: Aug. 19, 1996

[51] Int. Cl.[6] ..... B24B 49/00

[52] U.S. Cl. ..... 451/6; 451/9; 451/41; 451/287; 451/288

[58] Field of Search ..... 451/41, 6, 9, 10, 451/11, 285, 287, 288, 289

[56] References Cited

U.S. PATENT DOCUMENTS

| | | | |
|---|---|---|---|
| 4,739,590 | 4/1988 | Myers et al. | 451/11 |
| 5,077,941 | 1/1992 | Whitney | 451/11 |
| 5,135,727 | 8/1992 | Ibe | 125/23.01 |
| 5,222,329 | 6/1993 | Yu | 451/11 |
| 5,439,551 | 8/1995 | Meikle et al. | 156/626.1 |
| 5,498,196 | 3/1996 | Karlsrud et al. | 451/11 |
| 5,562,530 | 10/1996 | Runnels et al. | 451/41 |

*Primary Examiner*—Eileen P. Morgan
*Attorney, Agent, or Firm*—Lowe, Price, LeBlanc & Becker

[57] ABSTRACT

A precision polishing system able to polish samples to an accuracy within the submicron range is disclosed. The novel polishing system has applications in the semiconductor field for use in polishing silicon wafers during testing and quality control inspections. In the examination of failed wafers during the semiconductor manufacturing process, it is desirable to examine a cross section of the wafer at the point of failure. The polishing system of the present invention enables very accurate polishing of the wafer down to the submicron accuracy range. The sample is held is place by a gripper assembly which is attached to a polishing arm slideably connected to a fixed rail. The polishing arm is raised and lowered to polish the sample using a polishing wheel covered with a suitable abrasive. A video microscope attached to an object lens and a video camera provide images that are processed to control the polishing operation. The video microscope is mounted on a precision X-Y table to facilitate focusing and defect location of the sample in addition to forming part of the closed loop control of the polishing process. Two closed loop feedback control methods are utilized by the invention to achieve high polishing accuracies. The first utilizes electromechanical means to perform rough polishing of the sample. The second method utilizes digital image processing techniques to accurately control the movement of a polishing arm which holds the sample as it is polished.

23 Claims, 12 Drawing Sheets

PRECISION POLISHING SYSTEM

FIELD OF THE INVENTION

The present invention relates generally to metallography polishers and more particularly relates to a polisher for polishing silicon wafers to submicron precision.

BACKGROUND OF THE INVENTION

Metallography polishers are used extensively in the surface preparation of raw materials and for preparation of samples for microstructural analysis. Silicon wafer cross section polishing is used to prepare a surface on the wafer sample that is suitable for inspection under an optical microscope or a scanning electron microscope (SEM). The semiconductor industry uses polishing for various purposes, such as in failure analysis, process control, research and development and field failure. In addition, polishing is used in the analysis of flaws that occur during the lithographic processing of the wafer whereby a specific location on the wafer is to be inspected.

In failure analysis, a defective process is investigated by analyzing and inspecting the cross section of the silicon wafer in the area of the flaw. Polishing is used in process control to monitor the wafer manufacturing process at various steps in order to confirm compliance with manufacturing specifications. Semiconductor fabrication facilities constantly try to improve their fabrication process in order to increase yield and the quality of products. The process engineer tests new procedures and analyzes samples using cross sections of wafer samples.

Research and development engineers also utilize polishing to perform cross section inspections and analysis of silicon wafers during the course of testing new procedures. In the event of field failures, polishing is used to prepare cross sectional samples of failed parts returned by customers in order to assist in determining the cause of the failure. In addition, polishing is used in the semiconductor industry for microstructural analysis of microchips in failure analysis and process control during the die placement and packaging portion of the manufacturing process.

Polishing is also utilized by analytical laboratories that specialize in microstructural analysis of materials. These types of laboratories are found at most research institutes, universities and independent analytical laboratories. Typically, the first stage of the analysis of a sample involves preparation of either a cross section or a thin slice of the sample. In many cases it is desirable to polish to a specific point in the sample.

In addition, polishing is used extensively in the microstructural analysis of rock, sand, ore, coal and other natural materials. Polishing is used to reveal important information that is useful in the control of the extraction, refining and other processes that are employed to boost profitability of mining operations. Here also, cross sectional samples using reflected light and thin samples using transmitted light are useful in the analysis of materials. In many of these cases it is desirable to polish to a specific point in the sample.

Other applications of polishing include microstructural analysis of ferrous and non-ferrous materials, printed circuit boards (i.e., cross section of copper layers) and advanced materials (i.e., microsectioning of ceramics composites, coatings, polymers, etc.). Polishing is also useful in the analysis of passive electronic devices such as high-rel/high accuracy capacitors and resistors.

SUMMARY OF THE INVENTION

Accordingly, it is an object of the present invention to provide a polisher that overcomes the disadvantages of the prior art.

It is another object of the present invention to provide a polisher that is capable of polishing samples to an accuracy in the submicron range.

Yet another object of the present invention is to provide a polisher that is capable of polishing samples in an automatic fashion with minimal user intervention required.

Another object of the present invention is to provide a polisher that is capable of polishing to a precise target point preselected by a user.

Yet another object of the present invention is to provide a polisher that is capable of polishing samples to a point preselected by a user while avoiding any overpolishing of the sample.

The polishing system of the present invention is designed to be able to polish samples to an accuracy within the submicron range. The polishing system of the present invention has applications in the semiconductor field for use in polishing silicon wafers during testing and quality control inspections. In the examination of failed wafers during the semiconductor manufacturing process, it is desirable to examine a cross section of the wafer at the point of failure. The polishing system of the present invention enables very accurate polishing of the wafer down to the submicron accuracy range.

The sample is held in place by a gripper assembly which is attached to a polishing arm slideably connected to a fixed rail. The polishing arm is raised and lowered to polish the sample using a polishing wheel covered with a suitable abrasive. A video microscope attached to an object lens and a video camera provide images that are processed to control the polishing operation. The video microscope is mounted on a precision X-Y table to facilitate focusing and defect location of the sample in addition to forming part of the closed loop control of the polishing process. Two closed loop feedback control methods are utilized by the invention to achieve high polishing accuracies. The first utilizes electromechanical means to perform rough polishing of the sample. The second method utilizes digital image processing techniques to accurately control the movement of a polishing arm which holds the sample as it is polished.

There is thus provided in accordance with a preferred embodiment of the present invention a polishing system comprising a base, an X-Y table mounted onto the base, a microscope assembly mounted onto the X-Y table, a polishing wheel assembly, the polishing wheel assembly comprising a polishing wheel, a polishing arm assembly mounted onto the base, the polishing arm assembly comprising a polishing arm, a force control unit coupled to the polishing arm, the force control able to vary the amount of force applied to the polishing arm in accordance with a control signal, a gripper assembly coupled to one end of the polishing arm, the gripper assembly for holding in a fixed position a sample to be polished, and a controller for controlling the operation of the polishing system, the controller for generating the control signal.

The polishing system further comprises a rail connected to the X-Y table for moving the microscope assembly backwards to facilitate the changing of the polishing wheel.

The microscope assembly comprises a video camera, a video microscope coupled to the camera, and an objective lens coupled to the video microscope. An alternative is to use a zoom lens instead of or in combination with the objective lens. The microscope assembly further comprises a revolving adapter for holding at least one objective lens, the revolving adapter facilitating the changing of the at least one objective lens.

The polishing wheel assembly comprises a wheel base, a motor coupled to the wheel base, the polishing wheel coupled to the motor, and a sink bath coupled to the wheel base, the sink bath providing a receptacle for liquid applied to the polishing wheel during polishing operations.

The polishing arm assembly comprises a fixed slide rail connected to the base, a moveable slide rail slideably coupled to the fixed slide rail, the polishing arm connected to the moveable slide rail, a contact sensor coupled to a lower portion of the moveable slide rail, the contact sensor for sensing the movement of the polishing arm in the Z-axis direction, a contact pad fixably coupled to the base, a motor coupled to an upper portion of the polishing arm, the motor for raising and lowering the polishing arm and the moveable slide rail slideably connected to the fixed slide rail whereby when the polishing arm rests on the sample, the moveable slide rail is elevated and electrical contact between the contact sensor and the contact pad is broken.

The polishing arm permits the polishing of the sample to follow the hills and valleys of the polishing wheel while it is spinning. It also permits the determination of the distance between the highest peaks and the lowest valleys of the polishing wheel. In addition, the estimation of the absolute position of the sample in the Z-axis direction can be made with an accuracy of at least 15 micrometers. The motor comprises a 5 phase stepper motor.

The force control unit comprises a force generator coupled to the base, and a spring coupled between the force generator and the polishing arm assembly, the spring counteracting the weight of the polishing arm assembly in accordance with a control signal received by the force generator. The force generator comprises a motor which may be a 2 phase stepper motor.

The gripper assembly comprises a swivel base coupled to the polishing arm assembly, a swivelable member swivelably coupled to the swivel base, and a sample holder having a cylindrical gripper pin portion insertable into the swivelable member and held in place therein by a gripper fixing screw, the sample holder for firmly holding the sample to be polished in a fixed position, the sample held within the sample holder using a plurality of holding screws.

The controller comprises digital image processing means forming a portions of a closed feedback control loop for controlling the movement of the polishing arm.

The polishing system also comprises a cleaning system for surface cleansing and drying of the sample, which includes a container holding a cleaning material, a hose, having a first end and a second end, the first end coupled to the container, and a valve coupled to the second end of the hose. The cleaning material comprises liquid nitrogen and the valve comprises an electronically controlled valve.

The controller, suitably programmed, together with the microscope assembly and the polishing arm assembly form a closed loop feedback control system to locate landmarks and blobs on the sample in order to determine the required polishing height and precisely control the movement of the polishing arm with 0.25 micrometer resolution.

There is also provided in accordance with a preferred embodiment of the present invention a method for accurately controlling the polishing of a material sample, the sample held firmly in place in a gripper assembly connected to a polishing arm, the method comprising the steps of performing a first polishing stage utilizing relatively low resolution electromechanical means to control the movement of the polishing arm, and performing a second polishing stage utilizing precise digital imaging processing means to control the movement of the polishing arm.

The step of performing a second polishing step comprises accurately controlling a stepper motor connected to the polishing arm.

BRIEF DESCRIPTION OF THE DRAWINGS

The invention is herein described, by way of example only, with reference to the accompanying drawings, wherein.

DETAILED DESCRIPTION OF THE INVENTION

The polishing system of the present invention permits the polishing of crystals or other samples to accuracies in the submicron range. More specifically, the present invention is capable of polishing a sample to a very precise height or to a precise location on the sample with an accuracy of less than a micron. The present invention utilizes an active closed loop feedback control system which comprises micropositioners, a video camera equipped microscope and an isotonic balanced polishing arm. The invention has application where precise shape, accurate cuts and precise surfaces are to be generated.

Figure 1:
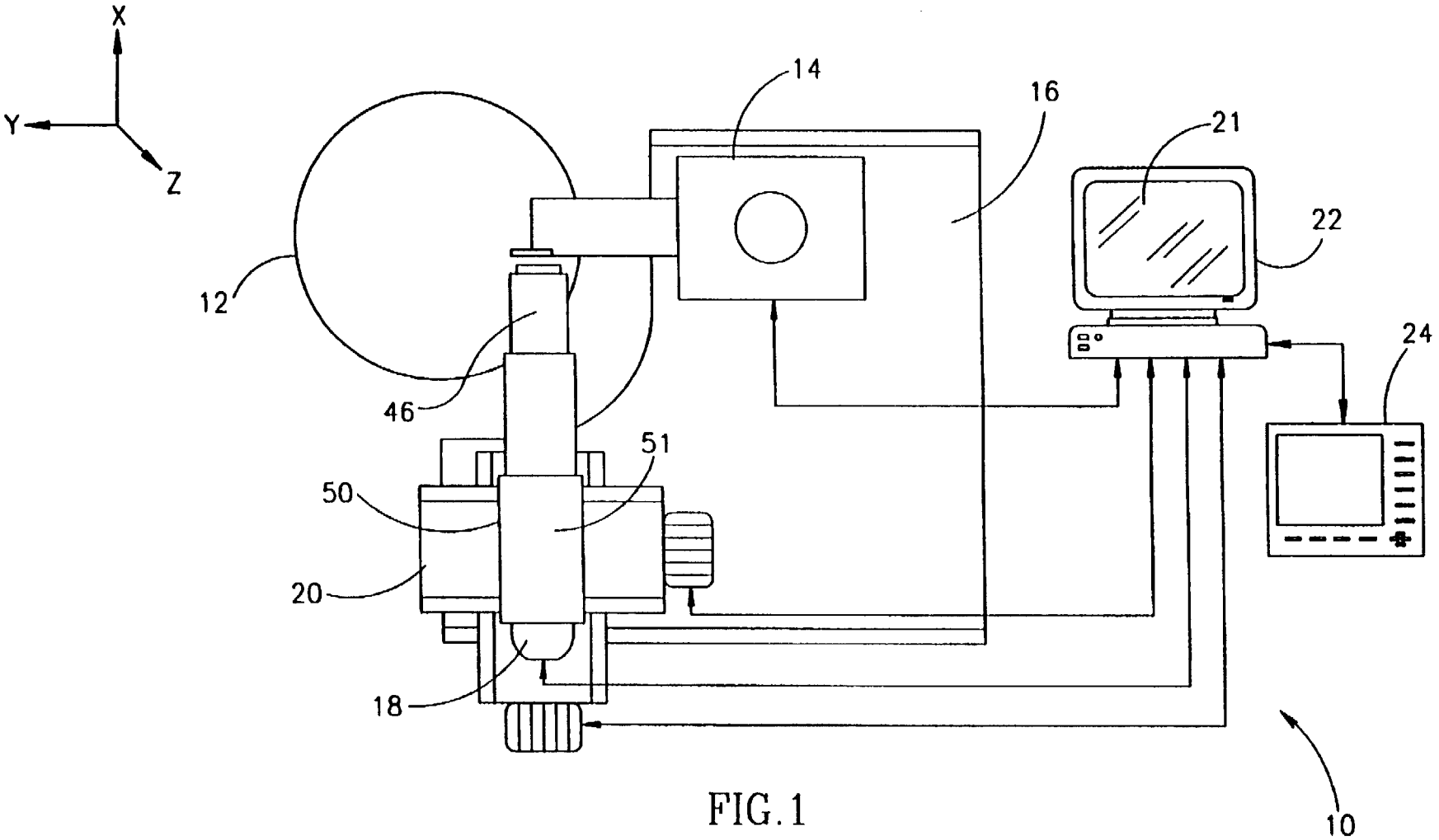
FIG. 1 is a top plan view illustrating a polishing system constructed in accordance with a preferred embodiment of the present invention.

A high level block diagram illustrating the major components of a polishing system, generally referenced 10, constructed in accordance with a preferred embodiment of the present invention is shown in FIG. 1. The system 10 comprises a polishing wheel assembly 12, polishing arm assembly 14, base table 16, a microscope assembly 50, X-Y positioning table 20, a force control assembly 32 (not shown), computerized controller 22 and a user input control device 24. Also shown in FIG. 1 are a video camera 18, objective lens 46 and a high resolution display monitor 21.

The controller 22 may comprise a conventional personal computer (PC) such as an Intel Pentium based PC equipped with a high resolution video capture card, an electronic controller card for controlling motors, an electronic card for receiving sensor input from multiple sensors, a high resolution display monitor, an operating system such as Microsoft Windows 95 and a suitably written control program.

Figure 2:
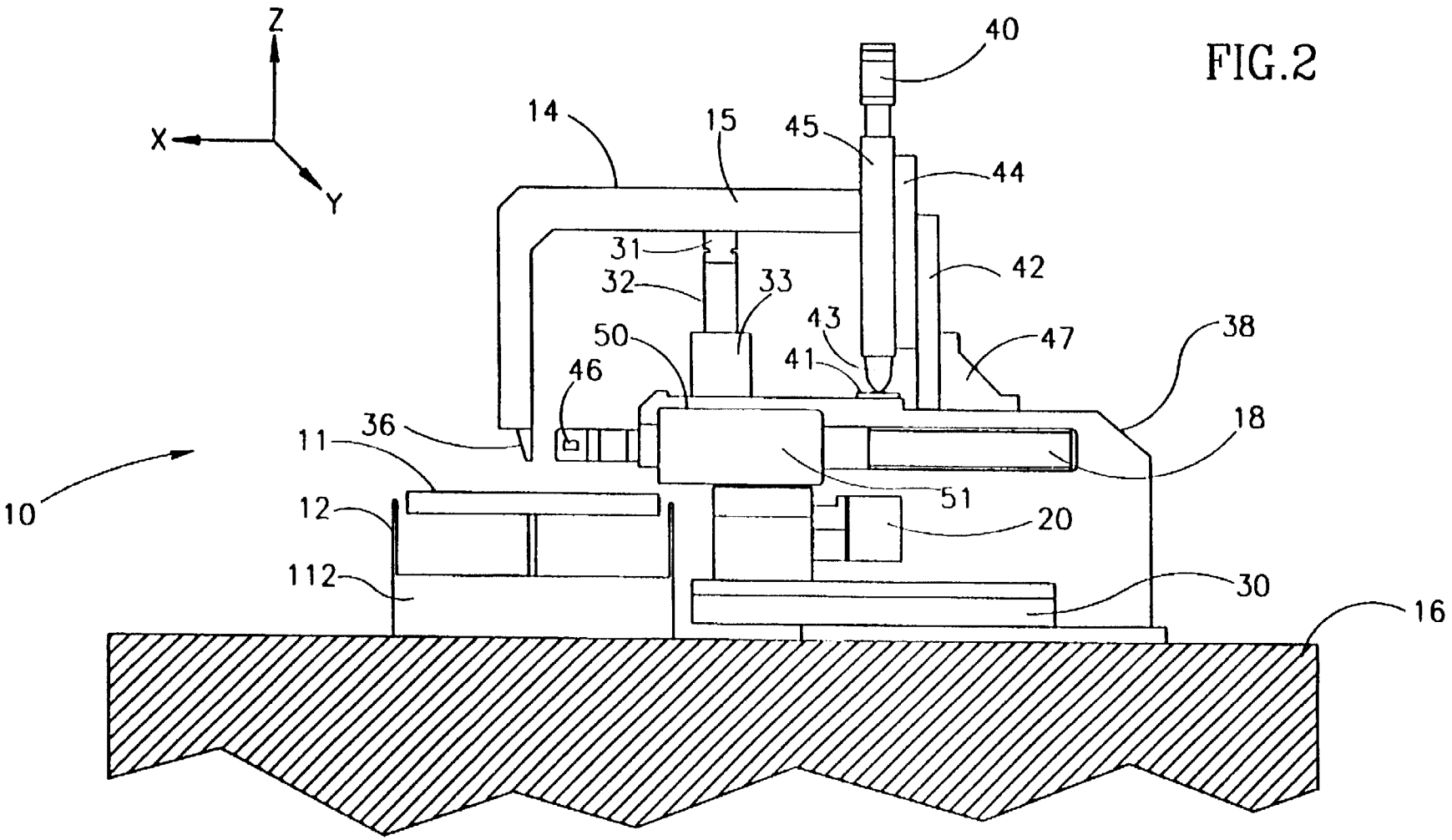
FIG. 2 is a side view of the polishing system of the present invention.

A side view of the polishing system 10 of the present invention is shown in FIG. 2. Illustrated in FIG. 2 is a table base 16 and a main rail 30 of the X-Y table 20. The rails 30 allow for manual movement of the microscope assembly along the X-axis. The microscope can be slid backwards to facilitate access to the polishing wheel 11 to make it easier for a user to change the polishing wheel or the abrasive cloth. The polishing wheel can be set in its operational location by a locking arm (not shown). Mounted on the base is the microscope assembly 50. The microscope assembly 50 comprises a microscope 51, a video camera 18, objective lens 46 and a microscope cover 38. The system 10 also comprises the polishing wheel assembly 12 and the polishing arm assembly 14. The polishing arm assembly 14 comprises a polishing arm 15 which is connected to a movable slide rail 45 which is slideably coupled to a fixed slide rail 44. Fixed slide rail 44 is fixably coupled to support 42 which is connected to the base and braced by corner member 47. Coupled to the upper portion of moveable slide rail 45 is a motor 40 for controlling the height of the polishing arm 15 in the Z-axis direction. Coupled to the lower portion of the moveable slide rail 45 is a contact sensor 43. During operation of the system 10, moveable slide rail 45 gradually stops its downward movement upon contact sensor 43 contacting contact pad 41. Coupled to the end of the polishing arm 15 is a gripper assembly 36. The polishing arm 15 is suspended by and coupled to a force control assembly 32. The force control assembly 32 comprises a force generator 33 and a dynamic spring 31.

Figure 3:
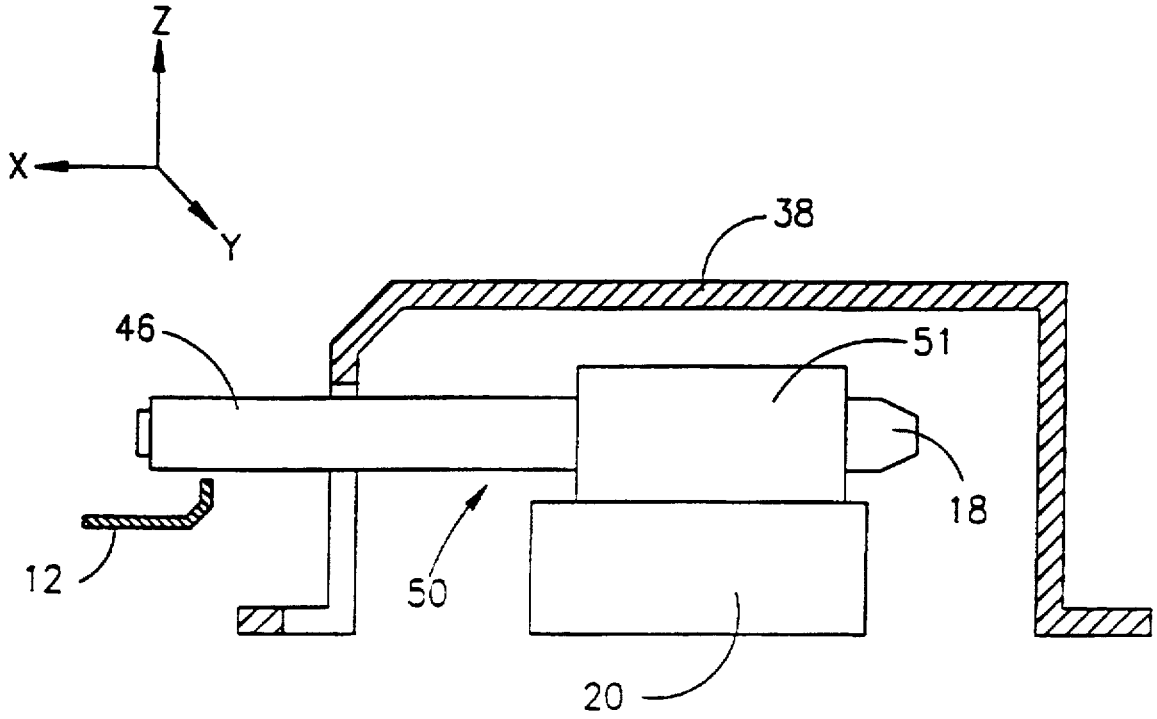
FIG. 3 is a side view of the microscope assembly portion of the polisher of the present invention.

A side view of the microscope assembly portion 50 of the present invention is shown in FIG. 3. The microscope assembly 50 comprises a video microscope 51 mounted on the X-Y table 20. A video camera 18 is coupled to the microscope 51. Also attached to the microscope 51 is objective lens 46. A cover 38 provides protection for the microscope assembly. Also shown in FIG. 3 for reference purposes is a portion of the polishing assembly 12. The video camera 18 is a high resolution monochrome CCD camera but may also comprise a color camera. The camera preferably conforms to the NTSC video standard and comprises a camera control unit (CCU). A preferred camera is the model iSC2050 manufactured by I-sight, Tirat-Hacarmel, Israel or model JAI 1541 manufactured by JAI A-S, Copenhagen, Denmark. The CCU can perform some type of image preprocessing, for example, varying sharpness and applying different weights to different image areas.

The microscope 51 is a very high resolution video microscope having a resolution on the order of 0.5 micrometer and having coaxial illumination. The video microscope is used as an online inspection tool for the polishing process. To achieve a sufficient range for the field of view, the video microscope is implemented using a 40X zoom system with an infinity corrected objective lens. As an alternative, a revolving objective adapter may be used that comprises a number of objectives mounted thereon. The maximum field of view of the microscope assembly is approximately 2 mm by 2 mm. The objective lens is preferably implemented using a 40X zoom system manufactured by Navitar, Rochester, N.Y., U.S.A. More specifically, the optical system can be implemented from elements presented in the table below.

Optical System Components

| Part Number | Description |
|---|---|
| 1-6010 | C mount coupler |
| 1-60185 | 2X non-inverting right angle adapter |
| 1-60165 | right angle coupler |
| 1-60707 | 40X motorized zoom and fine focus with coaxial illumination |
| 3-60160 | Mitutoyo objective adapter |
| 1-60226/1-60227/1-60228 | 5X or 10X or 20X Ultra Long WD objective (Mitutoyo) |
| 1-6191 | Fiber optic illuminator |
| 1-60106 | Flex fiber optic pipe |

Additionally, the video microscope comprises an objective lens that satisfies the field of view (FOV) requirements. Existing optical microscopes typically used in scanning electron microscope (SEM) laboratories use six different types of objectives with a X10/22 eye piece. The following table summarizes the optical characteristics of existing optical microscopes.

Optical Characteristics - Conventional Objective Lenses

| Objective | Magnification | FOV |
|---|---|---|
| X5 | 50 | 4.400 mm |
| X10 | 100 | 2.200 mm |
| X20 | 200 | 1.100 mm |
| X50 | 500 | 0.440 mm |
| X100 | 1000 | 0.220 mm |
| X160 | 1600 | 0.137 mm |

The above calculations are made utilizing the following equation for the FOV value expressed in mm.

$$FOV \cong \frac{\text{Field Number}(FN)}{\text{Objective}}$$

The value used for the field number is 22 mm which is a function of the eye-piece used in the system. Using a X40 zoom system (i.e., Navitar) with an attached objective, the following optical characteristics can be obtained.

Optical Characteristics - Optical System of the Present Invention

| Objective | Small FOV | Large FOV |
|---|---|---|
| X5 | 0.125 mm | 5.18 mm |
| X10 | 0.060 mm | 2.50 mm |
| X20 | 0.030 mm | 1.25 mm |

Using the table presented above, an optimal objective can be selected in accordance with desired performance characteristics.

The X-Y table 20 provides a mounting place and support for the optical system portion of the polishing system 10. The optical system is fixably mounted to the X-Y table using suitable fastening means known in the art. With reference to FIGS. 1 and 2, the X-axis direction of the table 20 is used as the axis of focus. The Y-axis direction of the X-Y table 20 is used to position the active field of view in the wafer plane, which is equivalent to the YZ plane.

Preferably, the X-Y table 20 is model XYM 100-50ST manufactured by Spindler & Hoyer, Göttingen, Germany and has the following specifications.

X-Y Table Specifications

| Feature | Value |
|---|---|
| X travel | 1 inch maximum |
| Y travel | 2 inches maximum |
| X resolution | 0.25 micrometers |
| Y resolution | 0.25 micrometers |
| XY repeatability | 1 micrometer |
| XY total accuracy | 1 micrometer |

With reference to FIGS. 1 and 2, the polishing assembly 14 functions to receive and hold the gripper assembly 36 and provide even guidance means for the polishing of the sample (i.e., the silicon wafer). The polishing arm 15 provides movement of the sample in the Z-axis direction. Its control is based on a stepper motor drive micrometer 40, such as model PI M-155.20 manufactured by Physik Instruments, Waldboronn, West Germany. The stepper motor drive micrometer is installed on the upper portion of the moveable slide rail 45 and includes a ball tip such as model PI M-219.10 also manufactured by Physik Instruments.

The specifications for this particular stepper motor drive micrometer include a 5-phase stepper motor having 1000 steps/revolution, a screw pitch of 0.5 mm and a resolution 0.5 micrometer for a full step and 0.25 micrometer for a half step. The stepper motor drive micrometer is used to control the height of the polishing arm for polishing operations as well as for controlling the Z-axis for inspection by the video microscope optical system.

The force used to polish samples is adjustable by the user of the polishing system. The force applied to the sample is directly controlled by the force control assembly 32. The force control 32 comprises a force generator 33 and a dynamic spring 31. The dynamic spring 31 is suitably connected to the polishing arm 15. The force generator 33 controls the length of the dynamic spring 31 so that the dynamic spring 31 pushes the polishing arm 15 up by an appropriate amount in order to reduce the weight of the polishing arm 15 to a suitable amount. The amount of force ultimately applied to the polishing arm 15 is set in accordance with the appropriate polishing force to be applied to the sample. The spring length is controlled by a 2-phase stepper motor located within the force generator 33. After the suitable force is dialed in, the spring stepper motor position follows the height of the polishing arm 15 in order to stabilize the force. The range of force applied to the sample during polishing operations is from 0.5 to 10 Newton-Force (NF). In carrying out the present invention, the inaccuracy of the spring must be taken into account. The characteristics of each spring must be measured beforehand in order for the force control unit to accurately determine the suitable settings for the dynamic spring and thus accurately control the force applied to the sample.

Figure 4B:
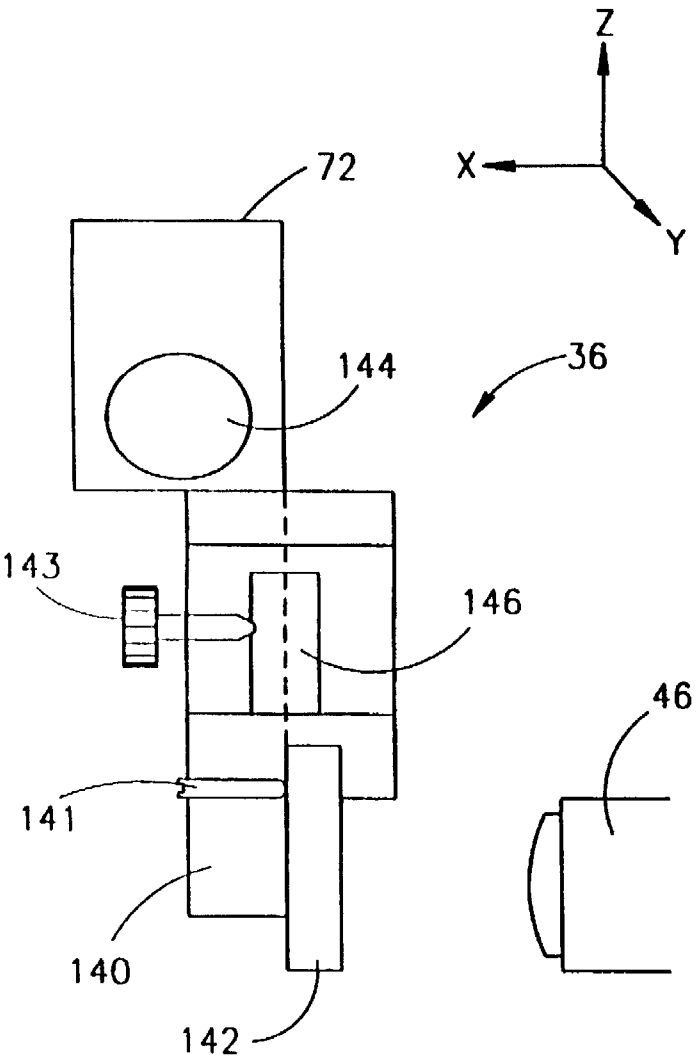
FIG. 4B is a side view illustrating the gripper assembly portion of the polishing system of the present invention.
Figure 4A:
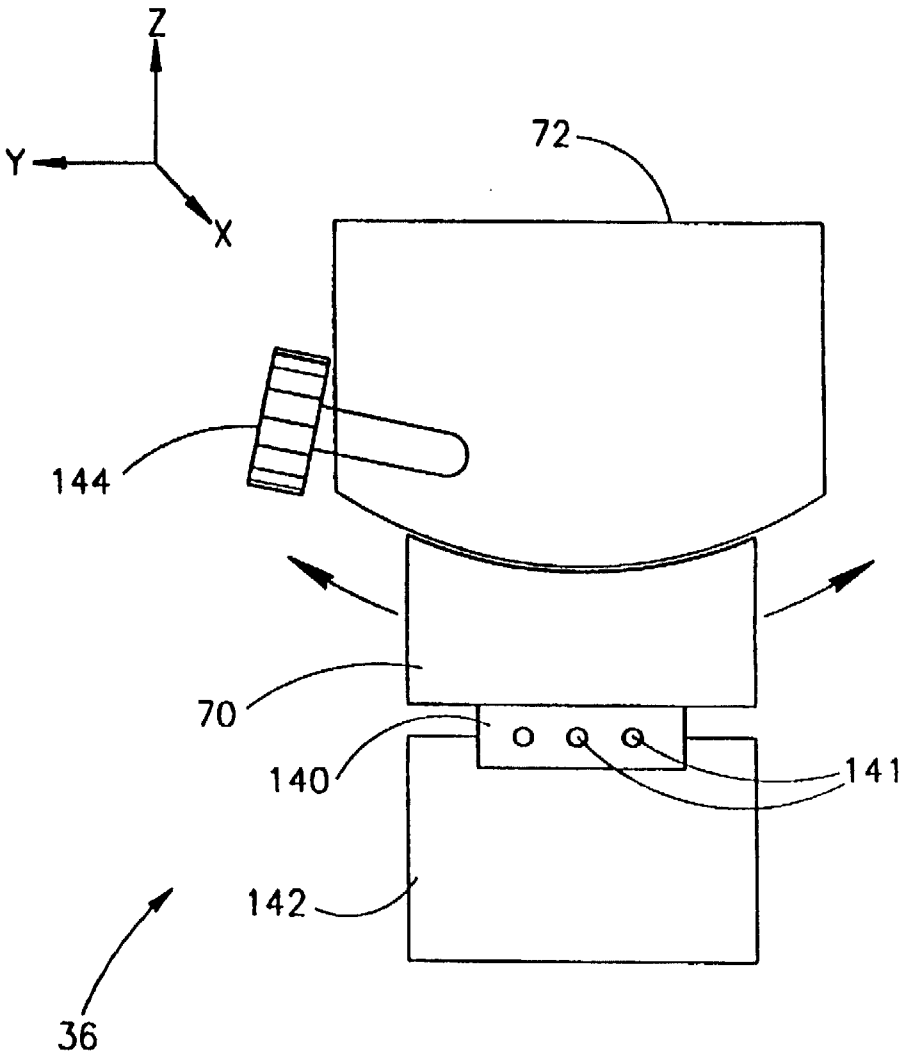
FIG. 4A is a block diagram illustrating the gripper assembly portion of the polishing system of the present invention.

A block diagram illustrating the gripper assembly 36 of the polishing system of the present invention is shown in FIG. 4A. A side view illustrating the gripper assembly 36 is shown in FIG. 4B.

With reference to FIGS. 4A and 4B, the gripper assembly 36 comprises a swivel base 72 connected to the lower portion of the polishing arm 15, a swivel screw 144, a swivelable member 70, a gripper fixing screw 143, a sample holder 140, holding screws 141 and a cylindrical gripper pin 146. The gripper assembly 36 holds the sample, referenced 142, (i.e., a silicon wafer) firmly in place during polishing operations and during the inspection by the video microscope. The sample to be polished or inspected is placed into sample holder 140 and held in place by one or more holding screws 141. In FIG. 4B, the end portion of the objective lens 46 is shown for reference illustrative purposes.

To assist in properly orienting and positioning the sample in order to polish to the desired cross section location, the polishing angle of the sample is adjustable in the YZ plane. The range of available swivel of swivelable member 70 is approximately −20° to +20°. The swivel angle is adjustable via swivel screw 144 which is tensioned against a fixed spring. To further automate the polishing process, in an alternative embodiment, the swivel angle can be controlled by a motor (not shown).

The polishing wheel 11 is shown to spin in the clockwise direction. The diameter of the polishing wheel 11 preferably matches the diameter of standard abrasive cloth. Preferably, the polishing wheel is of stainless steel construction and its top surface is polished in order to achieve highly accurate flatness and surface quality. In addition, the polishing wheel must be balanced in order to minimize vibrations that may potentially cause inaccuracies in polishing.

Figure 5:
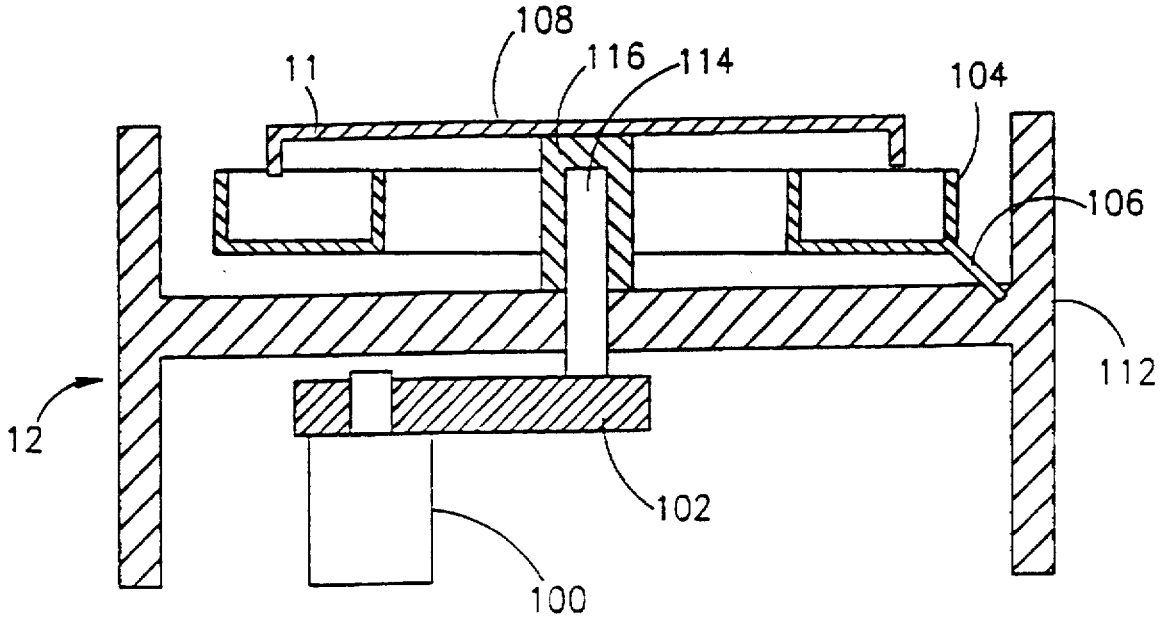
FIG. 5 is a cross sectional view illustrating in more detail the polishing wheel assembly portion of the polishing system.

A cross sectional view illustrating in more detail the polishing wheel assembly 12 of the polishing system 10 is shown in FIG. 5. The polishing wheel assembly 12 comprises a polishing wheel 11, spindle base 116, spindle 114, reduction gear 102, motor 100, sink bath 104, sink outlet 106 and wheel base 112. The polishing wheel 11 is rotated by a DC brushless motor 100 coupled to a reduction gear 102. The polishing wheel is spun at a speed in the range of between 10 to 500 revolutions per minute (RPM). The speed is controlled by the user via a speed control device such as a potentiometer (not shown) and/or through the controller 22 (FIG. 1). An abrasive cloth 108 is attached to the surface of the polishing wheel 11 using a suitable adhesive or other means such as a metal hold down rim.

Figure 6:
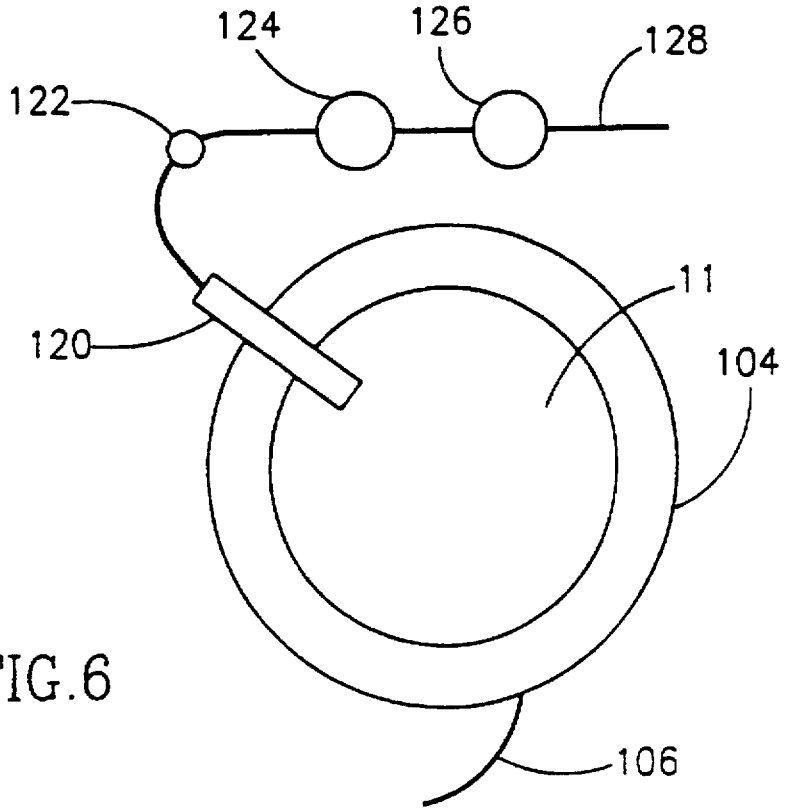
FIG. 6 is an upper view of the polishing wheel assembly portion of the polishing system illustrating the water dispensing system.

An upper view of the polishing wheel portion of the polishing system illustrating the water dispensing system is shown in FIG. 6. The water dispensing system comprises a water inlet pipe or hose 128, a first micronite filter 126, a second micronite filter 124, a flow control valve 122 and a dispenser pipe 120. Suitable piping or hoses are used to couple the operative elements together. Also illustrated is the polishing wheel 11, the sink bath 104 and the sink outlet 106.

Typically, to achieve accurate polishing results, wet polishing is performed using water as the liquid. A flow of water is created on the abrasive surface during the polishing process. The sink bath 104 provides a place for the liquid to drain into. The sink outlet 106 would typically be connected to a drain or other suitable means of disposing of the liquid.

The water flow rate is controlled electronically under program control via flow control valve 122 and can be turned on and off by the computerized controller 22 (FIG. 1). In operating the present invention, the water flow should be turned on at the start of the polishing process. The water flow rate can be also be controlled as needed by the user.

The water used is preferably filtered by two conventional micronite filters 124, 126 that function to remove any particles from the water that can interfere with the polishing of the sample. The micronite filters have a finite life span and should be replaced periodically in order to maintain accurate polishing.

In addition, the water should not be recirculated through the system but rather should be sinked out through sink pipe 106 to a drain. As illustrated in FIG. 5, the sink bath 104 slopes downward toward the sink pipe 106 in order to create a natural flow of water thereto.

Figure 7:
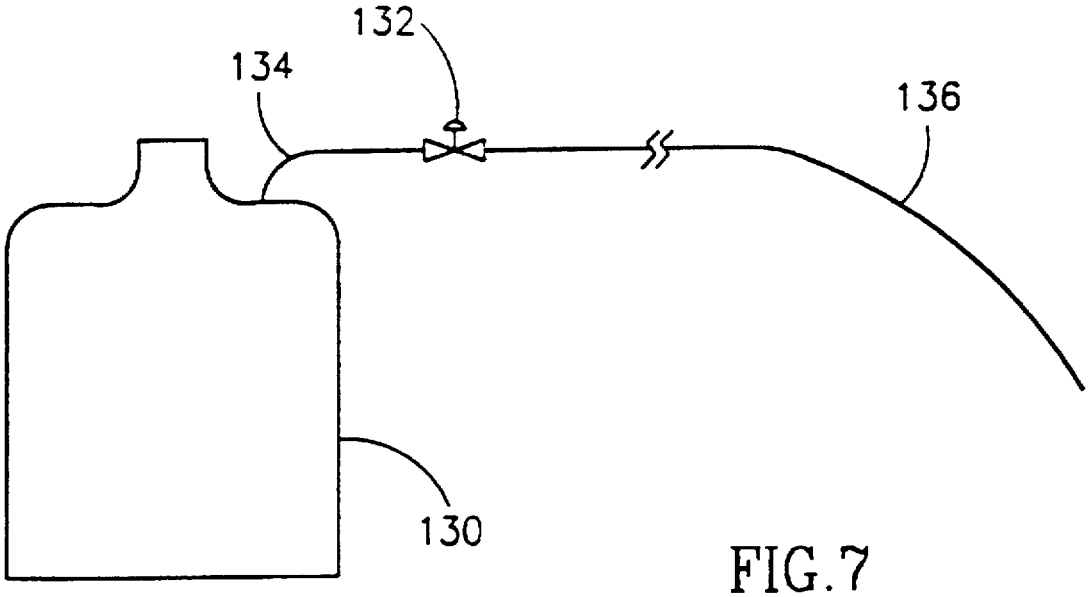
FIG. 7 illustrates the surface cleaning and drying portion of the polishing system.

The surface cleaning and drying portion of the polishing system is shown in FIG. 7. The surface cleaning and drying portion comprises a container of liquid nitrogen or other suitable cooling material 130, pipe 134, valve 132 and flexible goose neck pipe 136. In order to carry out accurate optical inspections of the sample (i.e., the silicon wafer), the sample should be clean and free of residual dust and water (i.e., from the polishing water dispenser). Cleaning of the sample is performed using dry nitrogen and the cleaning material. A supply of liquid nitrogen is stored in container 130 and fed through hose or pipe 134. The dry nitrogen flow is controlled by a computer controlled nitrogen valve 132. A flexible goose neck section of pipe or hose is secured to the system such that the dry nitrogen can be properly applied to the sample before optical inspection. The goose neck pipe is connected to the valve 132 through a section of hose. The controller 22 (FIG. 1) controls the flow of dry nitrogen, by opening valve 132, so that dry nitrogen is applied to the sample for approximately three seconds immediately preceding the optical inspection of the sample.

As discussed previously, the controller 22 comprises a conventional PC and, to ensure sufficient computing capability, preferably includes a 120 MHz Intel Pentium processor, 16 MB RAM, 1 GB hard disk drive, 3.5 inch floppy disk drive and a 17 inch VGA monitor. The controller also comprises a high resolution video capture card for capturing NTSC video from the video microscope 50 (FIG. 1). In addition, the controller 22 comprises an I/O control card for controlling the X-Y table 20 motion control (dual DC motors), Z-axis motion control of the polishing arm 15 (FIG. 1) (5-phase stepper motor), force control motor (2-phase stepper motor), microscope zoom and fine focus control (dual 2-phase stepper motors), polishing wheel 11 on/off control, flow control valve 122 (FIG. 6) for dispensing water and dry nitrogen valve 132 (FIG. 7) for dispensing dry nitrogen.

The controls made available to the user are provided through the use of an input control device 24 such as a smart joystick or graphics tablet. The smart joystick will permit user control over the position of the sample in the YZ plane for adjusting the field of view (FOV) location, the position of the sample in the X-axis direction for adjusting the focus and the level of desired zoom in or zoom out desired. In addition to a smart joystick, a user has control over certain parameters through the personal computer (PC). More specifically, the user can set the polishing wheel speed, adjust the polishing force applied to the sample and the duration of the polishing time-out period.

Figure 8:
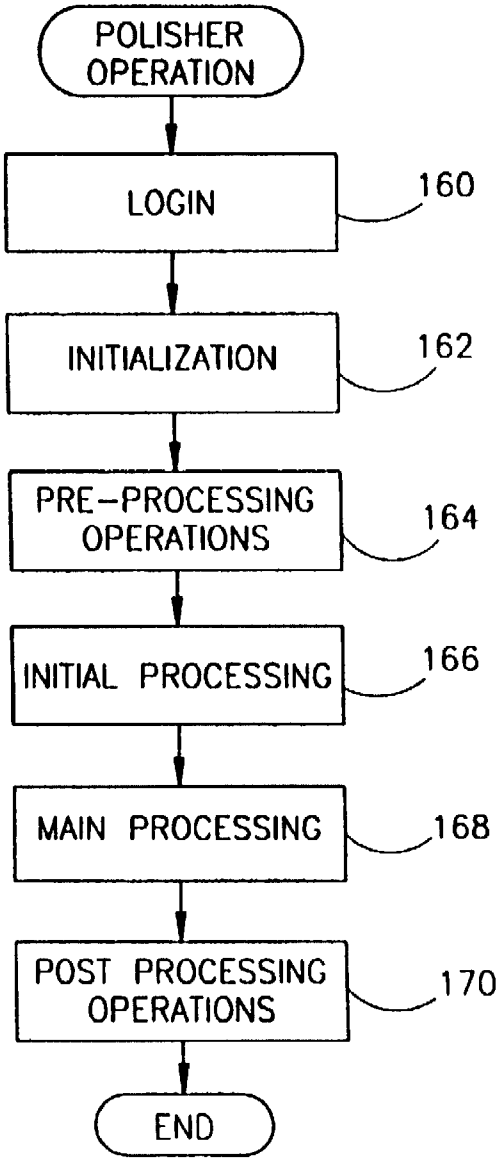
FIG. 8 is a high level flow diagram illustrating the operation of the polishing system of the present invention.

The software control of the polishing system will now be described in more detail. A high level flow diagram illustrating the software operation of the polishing system of the present invention is shown in FIG. 8. The first step is the user logging into the system (step 160). Once the user's user ID and password have been verified, the system is initialized and initial setup is performed (step 162). In the next step, pre-processing operations are performed (step 164). This is the first stage of polishing and includes basic user and system setup. Then initial processing occurs wherein rough polishing is performed (step 166) followed by the main processing wherein the final and accurate polishing is performed (step 168). Finally, post processing operations are performed after polishing is completed (step 170).

Figure 9:
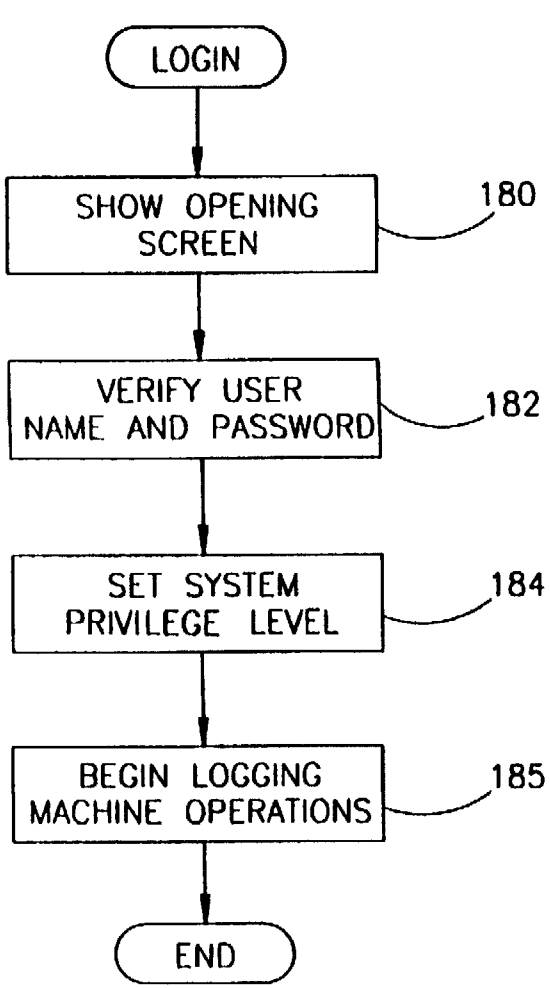
FIG. 9 is a high level flow diagram illustrating the login operation of the polishing system of the present invention.

A high level flow diagram illustrating in more detail the login operation of the polishing system of the present invention is shown in FIG. 9. Prior to being able to log in, a user must have been registered in the machine beforehand. This is performed by a system administrator or operator. The first step is to display the opening screen and optionally present a logo (step 180). The user is then prompted to enter a user ID and password. The user ID and password is verified against a database of valid user IDs and passwords (step 182). Once verified, the appropriate system privilege levels and allowable operations are set for that particular user in accordance with previously stored permissions in a database (step 184). Logging of all polishing machine operations is then begun (step 185).

Figure 10:
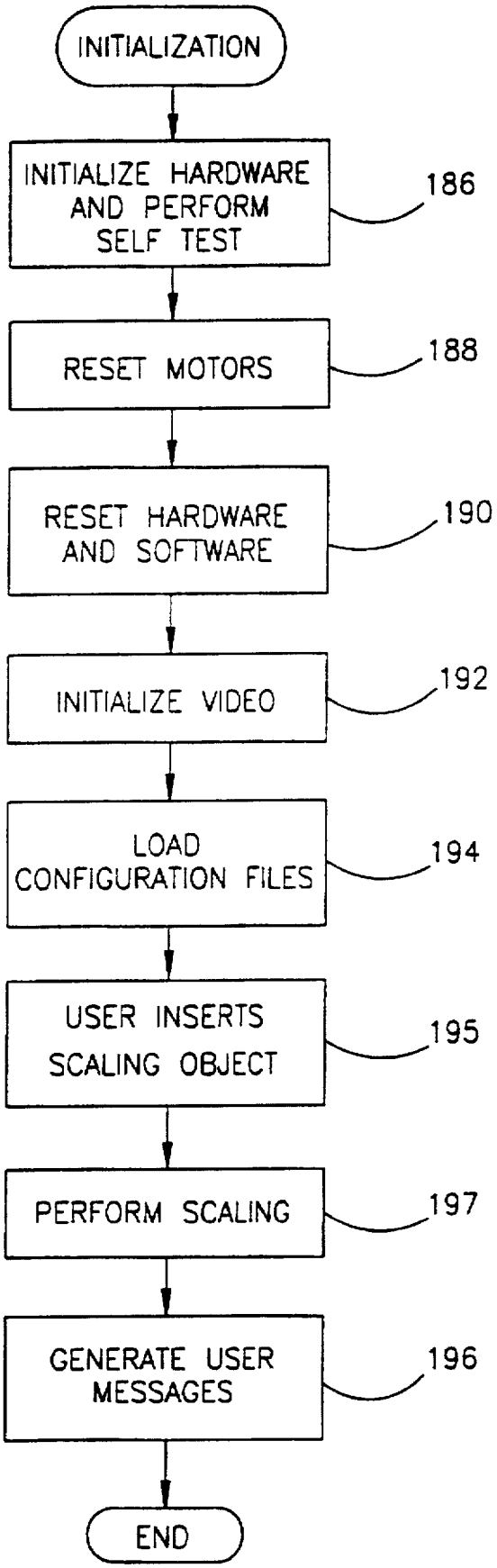
FIG. 10 is a high level flow diagram illustrating the initialization portion of the polishing system of the present invention.

Once the login portion is completed, the system is initialized. A high level flow diagram illustrating in more detail the initialization portion of the polishing system is shown in FIG. 10. First, the hardware controller cards in the system are initialized and self testing is performed (step 186). Once the hardware is initialized and tested, all motors in the system are reset and moved to their zero position (step 188). This ensures that motor commands received from the controller are referenced against an accurate starting point. Then all hardware counters and software counters are reset to their initial values (step 190). The video hardware including the associated display monitor are initialized and a live picture of the sample is put up on the display monitor (step 192). Any configuration files are then read causing any specified parameters to be modified (e.g., change zoom setting, move the sample to a certain location, etc.) (step 194). The user then inserts a scaling object (step 195) following by scaling being performed (step 197). Any messages generated thus far concerning possible problems are displayed to the user on the display monitor (step 196).

Figure 11:
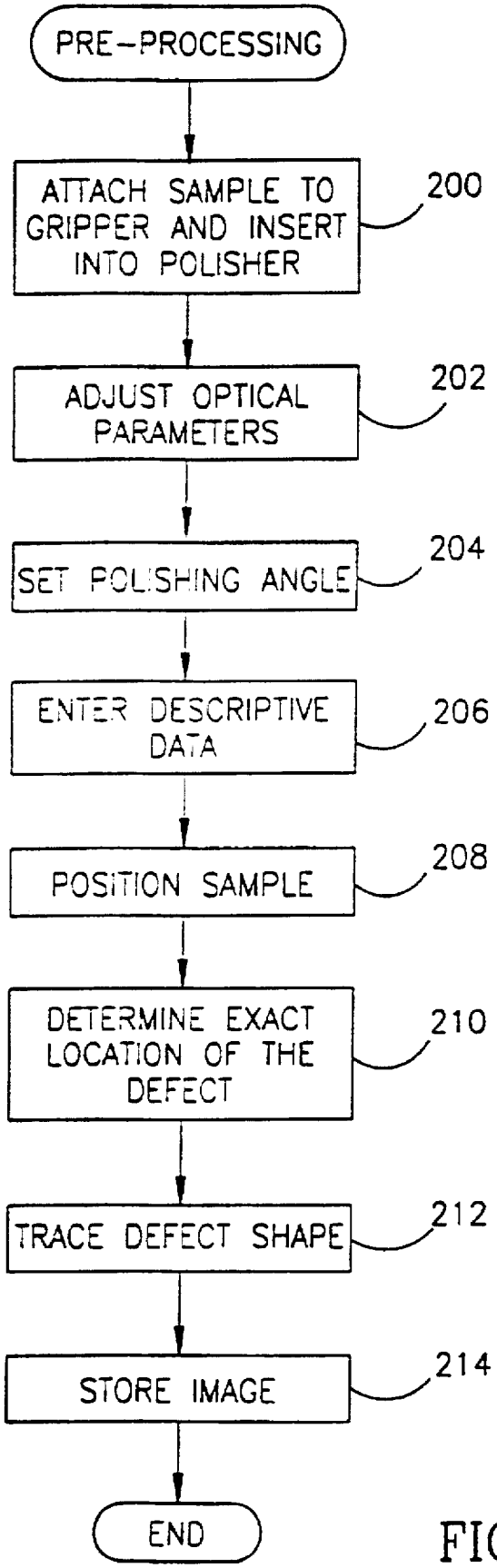
FIG. 11 is a high level flow diagram illustrating the pre-processing operations of the polishing system of the present invention.

A high level flow diagram illustrating in more detail the pre-processing operations of the polishing system is shown in FIG. 11. As described previously, the first phase of polishing is performed during this stage of processing. First, the user attaches the sample to the sample holder 140 in the gripper assembly 36 (FIGS. 4A and 4B) using holding screws 141 (step 200). The gripper assembly 36 is then inserted into the lower portion of the polishing arm 14 (FIG. 1). Next, the various optical parameters are adjusted (step 202). These parameters comprise adjusting the focus in the X-axis direction, checking illumination and sensitivity through the video microscope and switching to a default zoom. The user then sets the desired polishing angle via swivel screw 144 (step 204). The user is then prompted to enter descriptive data about the sample to be polished (e.g., serial number, size, batch run number, etc.) (step 206). The user then positions the sample such that the point of interest (e.g., the defect) appears at the center of the view as displayed on the display monitor (step 208).

Then, under automatic control, the polishing system determines the exact location of the polishing point of interest (i.e., the defect) on the sample in relation to the edge of the sample and to known discernible landmarks on the surface of the sample (step 210). For example, silicon wafers typically have reference letters and numerals etched onto their surfaces for assisting in locating particular spots on the wafer. The exact shape of the defect on the sample is then traced (step 212). This is performed using the fact the flaw or defect is situated at the center of the monitor (originally positioned by the user). A gray level or color concentric map of the wafer can be built around the center of the view. This map along with the landmark is utilized by the polishing system to locate the flaw on the wafer at the verification stage. The map comprises a collection of one or more blobs (in the terminology of digital image processing techniques).

The controller comprises processing means that performs well known digital image processing techniques to analyze the blob characteristics to locate the flaw. The blob characteristics are stored on the disk drive. The current video frame and related defect location parameters are then stored on the hard disk drive or other storage medium in the controller 22 (step 214). The images are stored on disk to permit a process engineer, for example, to review and analyze the images at a later time.

Figure 12:
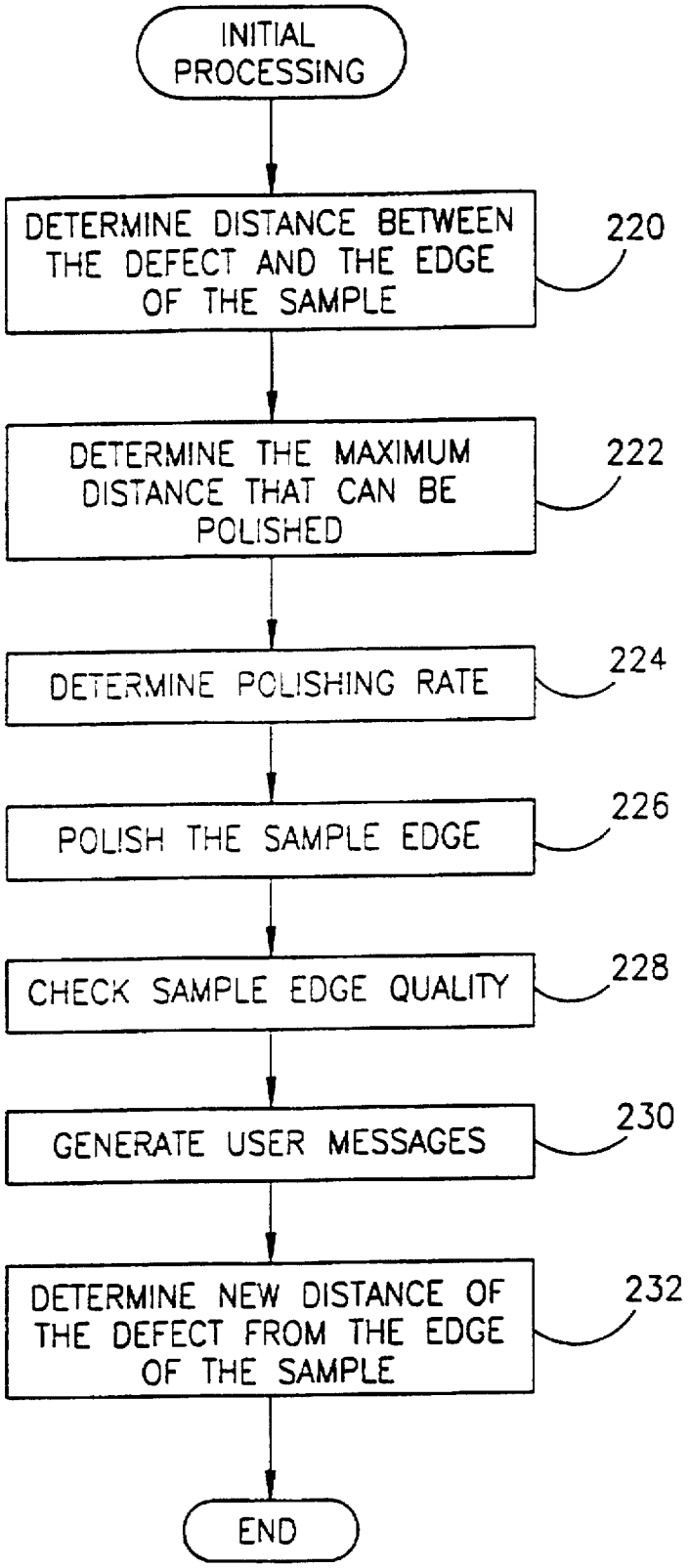
FIG. 12 is a high level flow diagram illustrating the initial processing operations of the polishing system of the present invention.

A high level flow diagram illustrating in more detail the initial processing operations of the polishing system of the present invention is shown in FIG. 12. During this phase of processing rough polishing is performed. First, the distance between the defect in the sample and the lower edge of the sample is measured (step 220). This is done by raising the polishing arm 14 (FIG. 1) until the sample edge is detected by the software. Since the starting point or zero reference point is known, the distance can be calculated. Then, the maximum allowable distance (e.g., in microns) that can be polished in order to straighten the rough edge (if any) of the sample edge is determined (step 222). Based on data input by the user and on internally derived parameters, a suitable polishing rate is determined (step 224).

At this point in the processing, the polishing arm 14 begins to descend downwards. At the point where the sample starts to be polished, contact sensor 43 is detached from the contact pad 41. The sample edge is then polished up to the maximum distance determined in step 222 (step 226). In accordance with the teachings of the invention, the maximum distance calculation during this stage should take into account the inaccuracy of the contact sensor, approximately 10 micrometers, the resolution of the optics at this magnification, the roughness of the polishing cloth, etc. The overall accuracy that can be achieved during this stage is approximately 50 micrometers.

The quality of the sample edge is then inspected (step 228). Any user messages, concerning possible problems for example, are displayed to the user (step 230). Once the rough polishing is completed the distance from the defect in the sample to the new lower edge of the sample is measured, as in step 222 (step 232).

Figure 13:
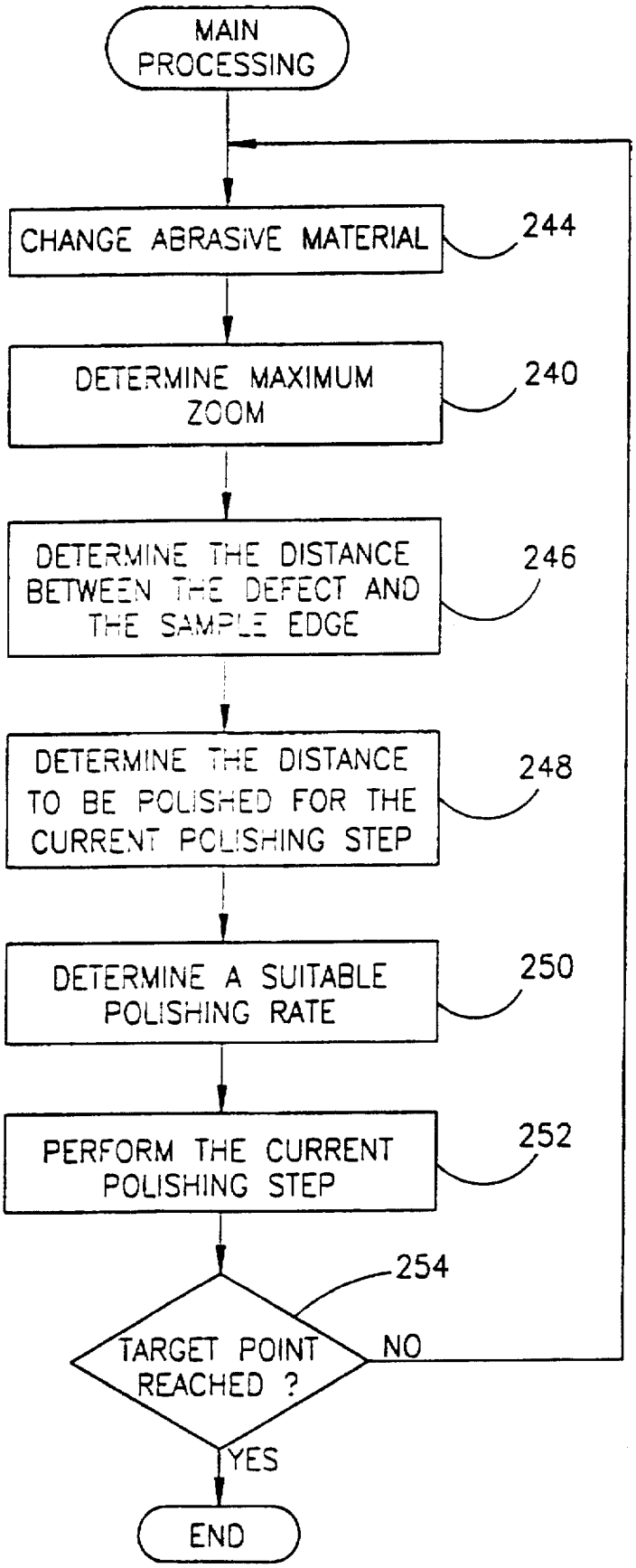
FIG. 13 is a high level flow diagram illustrating the main processing operations of the polishing system of the present invention.

The main or final polishing stage where the sample is precision polished will now be described in more detail. A high level flow diagram illustrating in more detail the main processing operations of the polishing system is shown in FIG. 13. The first step is to change the abrasive material covering the polishing wheel 11 (step 244). Then the maximum possible zoom is determined so that the sample edge and the defect can be easily seen on the screen (step 240). This step also includes performing any necessary focusing, depending on the type of optics employed in the system. The abrasive material used during the rough polishing stage is too rough or coarse to achieve the accuracy needed during the main polishing stage. Next, the length of the sample to be polished is determined (step 248). This calculation utilizes the current polishing parameters (i.e., distance of the sample defect to the sample edge, characteristics of the abrasive material, weight of the sample, characteristics of the dynamic spring, etc.). Based on the data known at this point, an appropriate polishing rate is determined (step 250). The sample is then polished using the parameters determined in the previous steps (step 252). This is performed by the 5 phase stepper motor creating an adjustable polishing gap. The rate is controlled in this fashion. For example, if it is determined that 10 micrometers of free polishing can safely be performed without destroying the target location on the wafer, a polishing gap of 10 micrometers is then created. If a gap, for example, of 0.25 micrometers is desired, this can also be created. Once the gap is closed due to sample polishing (i.e., descending of the polishing arm assembly 15) the polishing arm does not descend any further. At this point, the arm will rest on the contact pad. The sample is then raised in height in order to perform video grabbing and subsequent image processing analysis. The wafer is analyzed and compared against the original first frame, using the stored landmarks and shapes and locations of the blobs, to determine the current polishing status. The main polishing stage just described is repeated (step 254) until the edge of the sample meets the target point (e.g., the defect line).

Two closed loop feedback control methods are utilized to control the polishing height. The first includes an electromechanical mechanism comprising the main rail 30, moveable slide rail 45, fixed slide rail 44, motor 40, contact sensor 43, contact pad 41 and support 42. This mechanism involves using a large FOV with a low resolution setting yet permits a height resolution of at least 50 micrometers.

The second closed loop feedback control method utilizes video camera based digital image processing for the final submicron height control verification comprising the microscope assembly 50 and motor 40. The precise distance to be polished is calculated using imaging processing techniques and the polishing arm assembly 14 is then moved with high accuracy using the 5 phase stepper motor 50.

Figure 14:
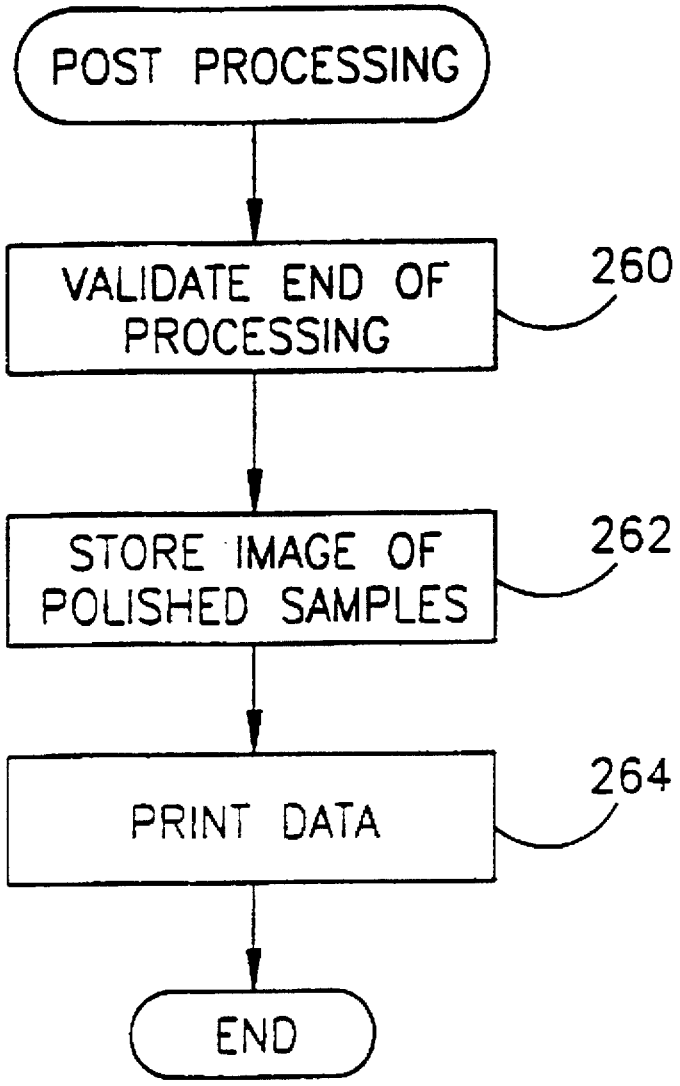
FIG. 14 is a high level flow diagram illustrating the post-processing operations of the polishing system of the present invention.

A high level flow diagram illustrating in more detail the post-processing operations of the polishing system is shown in FIG. 14. This is the last stage of processing and is performed after the polishing of the sample is completed. First, the end of processing is validated (step 260). The validation is performed using the landmarks on the wafer and also the blob analysis software, if required. Next, the image of the polished sample in its final state is stored on the disk medium for future reference (step 262). Finally, in response to an optional request by the user, information about the polishing process and the particular sample polished can be printed out (step 264).

While the invention has been described with respect to a limited number of embodiments, it will be appreciated that many variations, modifications and other applications of the invention may be made.

What is claimed is:

1. A polishing system, comprising:

a base;

an X-Y table mounted onto said base;

a microscope assembly mounted onto said X-Y table, said microscope assembly for inspecting a sample during polishing;

a polishing wheel assembly mounted onto said base, said polishing wheel assembly comprising a polishing wheel;

a holding arm assembly mounted onto said base, said holding arm assembly comprising a holding arm for even guidance of the sample during polishing, said holding arm assembly providing movement of the sample in the z-axis direction;

a force control unit coupled to said holding arm, said force control able to vary the amount of force applied to said holding arm;

a gripper assembly coupled to one end of said holding arm, said gripper assembly for holding a sample to be polished in a fixed position relative to said polishing wheel assembly during polishing and during inspection using said microscope assembly; and a controller for controlling the operation of said polishing system, including said X-Y table, said holding arm assembly, said force control unit, said microscope assembly and said polishing wheel assembly for accurate polishing of the sample.

2. The polishing system according to claim 1, further comprising a rail connected to said X-Y table for moving said microscope assembly backwards to facilitate the changing of said polishing wheel.

3. The polishing system according to claim 1, wherein said microscope assembly comprises:

a video camera;

a video microscope coupled to said camera; and an objective lens coupled to said video microscope.

4. The polishing system according to claim 3, wherein said video camera is a high resolution monochrome video camera.

5. The polishing system according to claim 3, wherein said video camera is a color video camera.

6. The polishing system according to claim 3, wherein said microscope assembly further comprises a revolving adapter for holding at least one objective lens, said revolving adapter facilitating the changing of said at least one objective lens.

7. The polishing system according to claim 3, wherein said microscope assembly comprises a zoom lens for facilitating control of the magnification level.

8. The polishing system according to claim 1, wherein said polishing wheel assembly comprises:

a wheel base;

a motor coupled to said wheel base;

said polishing wheel coupled to said motor; and a sink bath coupled to said wheel base, said sink bath providing a receptacle for liquid applied to said polishing wheel during polishing operations.

9. The polishing system according to claim 1, wherein said holding arm assembly comprises:

a fixed slide rail connected to said base;

a moveable slide rail slideably coupled to said fixed slide rail;

said holding arm connected to said moveable slide rail;

a contact sensor coupled to a lower portion of said moveable slide rail, said contact sensor for sensing the movement of said holding arm in the Z-axis direction;

a contact pad fixably coupled to said base;

a motor coupled to an upper portion of said holding arm, said motor for raising and lowering said holding arm; and said moveable slide rail slideably connected to said fixed slide rail whereby when said holding arm rests on said sample, said moveable slide rail is elevated and electrical contact between said contact sensor and said contact pad is broken.

10. The holding arm assembly according to claim 9, further comprising means for tracking variations in surface height of said polishing wheel while it is spinning.

11. The holding arm assembly according to claim 9, further comprising means for determining a maximum variation in surface height of said polishing wheel.

12. The holding arm assembly according to claim 9, further comprising means for determining the position of the sample in the Z-axis direction.

13. The polishing system according to claim 9, wherein said motor comprises a 5 phase stepper motor.

14. The polishing system according to claim 1, wherein said force control unit comprises:

a force generator coupled to said base; and a spring coupled between said force generator and said holding arm assembly, said spring counteracting the weight of said holding arm assembly in accordance with a control signal received by said force generator.

15. The polishing system according to claim 14, wherein said force generator comprises a motor.

16. The polishing system according to claim 1, wherein said gripper assembly comprises:

a swivel base coupled to said holding arm assembly;

a swivelable member swivelably coupled to said swivel base; and a sample holder having a cylindrical gripper pin portion insertable into said swivelable member and held in place therein by a gripper fixing screw, said sample holder for firmly holding said sample to be polished in a fixed position, said sample held within said sample holder using a plurality of holding screws.

17. The polishing system according to claim 1, wherein said controller comprises digital image processing means forming a portions of a closed feedback control loop for controlling the movement of said holding arm.

18. The polishing system according to claim 1, further comprising a cleaning system for surface cleansing and drying of said sample, comprising:

a container holding a cleaning material;

a hose, having a first end and a second end, said first end coupled to said container; and a valve coupled to said second end of said hose.

19. The polishing system according to claim 18, wherein said cleaning material comprises liquid nitrogen.

20. The polishing system according to claim 18, wherein said valve comprises an electronically controlled valve.

21. The polishing system according to claim 1, wherein said controller together with said microscope assembly and said holding arm assembly form a closed loop feedback control system to locate landmarks and blobs on said sample in order to determine the required polishing height and precisely control the movement of said holding arm.

22. A method for accurately controlling the polishing of a sample, said method comprising the steps of:

determining the location of a polishing point of interest on the sample in relation to an edge of the sample and to any known discernible landmarks on the surface of the sample;

tracing the shape of the polishing point of interest on the sample so as to generate a map of the sample containing a collection of one or more blobs;

determining a first distance to be polished and a corresponding first polishing rate that will yield a straight lower edge of the sample;

polishing the sample utilizing a low resolution electromechanical mechanism in accordance with said first distance to be polished and said first polishing rate;

inspecting the sample and determining a second distance to be polished and a corresponding second polishing rate utilizing high resolution video camera based digital image processing;

polishing the sample in accordance with said second distance to be polished and said second polishing rate; and repeating said steps of inspecting and polishing until the lower edge of the sample reaches the polishing point of interest.

23. The method according to claim 22, wherein said step of polishing the sample in accordance with said second distance to be polished and said second polishing rate comprises accurately controlling a motor connected to said holding arm.

* * * * *